US006391839B1

(12) United States Patent
Addison et al.

(10) Patent No.: US 6,391,839 B1
(45) Date of Patent: May 21, 2002

(54) DETERGENT BLEACH COMPOSITIONS CONTAINING LAYERED SILICATE BUILDER AND PERCARBONATE STABILIZED BY EDDS

(75) Inventors: Michael Crombie Addison, Forest Hall; Michael Alan J. Moss, Prudhoe, both of (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 08/379,576

(22) PCT Filed: Jul. 21, 1993

(86) PCT No.: PCT/US93/06877

§ 371 Date: Apr. 27, 1995

§ 102(e) Date: Apr. 27, 1995

(87) PCT Pub. No.: WO94/03554

PCT Pub. Date: Feb. 17, 1994

(30) Foreign Application Priority Data

Aug. 1, 1992 (GB) ..... 9216410

(51) Int. Cl.[7] ..... C11D 3/395

(52) U.S. Cl. ..... 510/315; 510/372; 510/375; 510/377; 510/428

(58) Field of Search ..... 252/95, 99, 102, 252/527, 546, DIG. 11; 510/372, 375, 428, 315, 377

(56) References Cited

U.S. PATENT DOCUMENTS

| | | | | |
|---|---|---|---|---|
| 3,929,678 A | * | 12/1975 | Laughlin et al. | |
| 4,075,116 A | | 2/1978 | Mesaros | 252/102 |
| 4,079,020 A | * | 3/1978 | Mills et al. | |
| 4,378,300 A | | 3/1983 | Gray | 252/99 |
| 4,664,837 A | * | 5/1987 | Gray | 252/99 |
| 4,704,233 A | | 11/1987 | Hartman et al. | 252/527 |
| 4,737,306 A | | 4/1988 | Wichelhaus et al. | 252/95 |
| 4,917,814 A | * | 4/1990 | MacIntyre et al. | |
| 5,066,415 A | * | 11/1991 | Dany | 252/135 |

FOREIGN PATENT DOCUMENTS

| | | | | |
|---|---|---|---|---|
| WO | 92/09680 A | * | 6/1992 | 252/102 |

OTHER PUBLICATIONS

* Copy Provided in PCT/US93/06877.*

* cited by examiner

*Primary Examiner*—Margaret Einsmann
(74) *Attorney, Agent, or Firm*—Marianne Dressman; Kim William Zerby; Steven W. Miller

(57) ABSTRACT

Detergent compositions comprising ethylenediamine-N,N'-disuccinic acid or salts thereof, an alkali metal percarbonate bleach and a crystalline layered sodium silicate of formula $LMSi_xO_2xH.yH_2O$ wherein L is an alkali metal, and M is sodium or hydrogen, x is a number from 1.9 to 4 and y is a number from 0 to 20 are provided. The compositions also preferably comprise additional non-phosphate detergent builder compounds.

3 Claims, No Drawings

DETERGENT BLEACH COMPOSITIONS CONTAINING LAYERED SILICATE BUILDER AND PERCARBONATE STABILIZED BY EDDS

This invention relates to detergent compositions containing crystalline layered silicates , an alkali metal percarbonate bleach and ethylenediamine-N,N'-disuccinic acid or salts thereof.

Detergent compositions incorporating layered sodium silicates are known in the art, being disclosed in, for example, DE-A-3413571, DE-A-3812556 and EP-A-0337219. These disclosures teach that the layered crystalline forms of sodium silicate display superior mineral hardness sequestration ability relative to the corresponding silicate salts in amorphous form and are thus advantageous as detergent builder materials.

Laundry detergent compositions containing the nil-phosphorus chelant, ethylenediamine-N,N'-disuccinic acid (EDDS) are also known in the art, being disclosed in, for example, EP-A-0267 653. This disclosure teaches that EDDS when incorporated in such laundry compositions assists in the removal of food, beverage and certain other organic stains from fabrics during the laundry process. It also teaches that EDDS may be used as a replacement for all or part of the phosphonate chelants currently used in many existing laundry products.

Detergent compositions containing sodium percarbonate are known in the art. Sodium percarbonate is an attractive perhydrate for use in detergent compositions because it dissolves readily in water, is weight efficient and, after giving up its available oxygen, provides a useful source of carbonate ions for detergency purposes.

Considerable interest exists in the development of more 'environmentally friendly' detergent compositions and processes for washing laundry in the home. The term 'environmentally friendly' as applied to home wash processes has many connotations, but will include those processes which consume less energy, by operating at lower temperatures and/or using lower volumes of water. 'Environmentally friendly' detergent compositions are often characterised in that they minimize the levels of components which may cause environmentally undesirable effects. These components may include for example any components which contain phosphorus, which has been linked to undesirable effects in lakes and rivers, and any components which contain boron whose persistence in the environment is also of possible concern.

Detergent compositions of the so-called 'compact' type which are of higher bulk density and contain lower amounts of filler salts than conventional laundry detergent products also provide an environmental benefit in that these provide equivalent performance from a smaller volume of powder. Thus, comparable cleaning results may be obtained from a smaller box of compact product as from a larger box of conventional product and this allows a reduction in packaging requirements to be made.

The Applicants have now discovered that surprising stain removal benefits are obtained, particularly on bleachable and enzymatic stains, for a detergent composition comprising in combination a crystalline layered sodium silicate, alkali metal percarbonate bleach and EDDS. Detergent compositions comprising this zero phosphorus, zero boron, builder/bleach/chelant system may be formulated such that stain removal performance benefits are obtained even when reduced amounts in total of builder, bleach and chelant are used.

It is therefore an object of the present invention to provide detergent compositions comprising a zero phosphorus and boron containing builder/bleach/chelant system.

It is a further object of the present invention to provide detergent compositions which may be used at lower dosage level in a home laundry process.

According to the present invention there is provided a detergent composition comprising;

(a) from 1% to 80% by weight of a crystalline layered silicate builder material of formula $LMSi_xO_{2x+1}.yH_2O$ wherein L is an alkali metal, and M is sodium or hydrogen, x is a number from 1.9 to 4 and y is a number from 0 to 20;

(b) from 3% to 40% by weight of an alkali metal percarbonate bleach;

(c) from 0.1% to 10% by weight of ethylenediamine-N, N'-disuccinic acid, or alkali metal, alkaline earth, ammonium or substituted ammonium salts thereof, or mixtures thereof.

Preferably, the compositions of the invention are free from any phosphorus or boron containing compounds.

The detergent compositions of the invention comprise three essential components, viz. the crystalline layered silicate, the alkali metal percarbonate bleach and the ethylenediamine-N,N'-disuccinic acid or salt thereof.

The crystalline layered silicate material has the general formula $$LMSi_xO_{2x+1}.yH_2O$$

wherein L is an alkali metal, preferably Na, and M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649, DE-A-3742043 and DE-A-3718350. For the purposes of the present invention, x in the general formula above has a value of 2, 3 or 4 and is preferably 2. More preferably M is sodium and y is 0 and preferred examples of this formula comprise the α-, β-, γ- and δ- forms of $Na_2Si_2O_5$. These materials are available from Hoechst AG FRG as respectively NaSKS-5, NaSKS-7, NaSKS-11 and NaSKS-6. The most preferred material is $Na_2Si_2O_5$, NaSKS-6.

These materials are processed into free flowing solids with a particle size of from 150 to 1000 micrometers and preferably a bulk density of at least 800 g/liter preferably approximately 900 g/liter. However, as made, the crystals are fragile and break down easily into particles of size less than 100 micrometers.

In the granular detergent compositions of the present invention, the crystalline layered silicate comprises from 1% to 80% by weight of the composition, more preferably from 5% to 40% and most preferably from 7% to 20% by weight.

The crystalline layered silicate material is preferably present as a particulate in intimate admixture with a solid, water-soluble ionisable material. The solid, water-soluble ionisable material is selected from organic acids, organic and inorganic acid salts and mixtures thereof. The primary requirement is that the material should contain at least one functional acidic group of which the pKa should be less than 9, providing a capability for at least partial neutralisation of the hydroxyl ions released by the crystalline layered silicate. Surprisingly, it has been found for the purposes of the present invention, that the ionisable material need not have a pH <7 in solution, or be present in an amount capable of providing hydrogen ions in stoichiometric parity with the hydroxyl ions produced by dissolution of the crystalline silicate. In fact neutralisation of the ionisable material during storage of the particulate, whilst causing a loss in fabric damage benefit, does not eliminate it.

The ionisable material should also have a mean particle size not greater than 300 micrometers and preferably not greater than 100 micrometers. This facilitates uniform distribution of the ionisable material and the crystalline silicate and is believed to enhance localised pH reduction when the particulate dissolves in the wash liquor.

Suitable organic acids include ascorbic, citric, glutaric, gluconic, glycolic, malic, maleic, malonic, oxalic, succinic and tartaric acids, 1 hydroxy ethane 1,1-diphosphonic acid (EHDP), amino poly methylene phosphonic acids such as NTMP, EDTMP & DETPMP, and mixtures of any of the foregoing. Suitable acid salts include sodium hydrogen carbonate, sodium hydrogen oxalate, sodium hydrogen sulphate, sodium acid pyrophosphate, sodium acid orthophosphate, sodium hydrogen tartrate or mixtures of any of the foregoing.

The particulate mixture of crystalline layered silicate and solid water soluble ionisable material will have a pH of at least 10 (as measured on a 1% solution in 20° C. distilled water) and more usually will have a pH of at least 11, normally at least 11.5.

The incorporation of other ingredients additional to the crystalline layered silicate and ionisable water soluble compound can be advantageous particularly in the processing of the particulate and also in enhancing the stability of detergent compositions in which the particulates are included. In particular, certain types of agglomerates may require the addition of one or more binder agents in order to assist in binding the silicate and ionisable water soluble material so as to produce particulates with acceptable physical characteristics. The binder agents may be present at a level of from 0% to 20% by weight of the particulate. Preferably, the binder agents will be in intimate admixture with the silicate and ionisable water soluble material. Preferred binder agents have a melting point between 30° C.–70° C.. The binder agents are preferably present in amounts from 1–10% by weight of the particulate and most preferably from 2–5% by weight of the particulate.

Preferred binder agents include the $C_{10}$–$C_{20}$ alcohol ethoxylates containing from 5–100 moles of ethylene oxide per mole of alcohol and more preferably the $C_{15}$–$C_{20}$ primary alcohol ethoxylates containing from 20–100 moles of ethylene oxide per mole of alcohol.

Other preferred binder agents include certain polymeric materials. Polyvinylpyrrolidones with an average molecular weight of from 12,000 to 700,000 and polyethylene glycols with an average weight of from 600 to 10,000 are examples of such polymeric materials. Copolymers of maleic anhydride with ethylene, methylvinyl ether or methacrylic acid, the maleic anhydride constituting at least 20 mole percent of the polymer are further examples of polymeric materials useful as binder agents. These polymeric materials may be used as such or in combination with solvents such as water, propylene glycol and the above mentioned $C_{10}$–$C_{20}$ alcohol ethoxylates containing from 5–100 moles of ethylene oxide per mole. Further examples of binder agents in accord with the invention include the $C_{10}$–$C_{20}$ mono- and diglycerol ethers and also the $C_{10}$–$C_{20}$ fatty acids. Solutions of certain inorganic salts including sodium silicate are also of use for this purpose.

Cellulose derivatives such as methylcellulose, carboxymethylcellulose and hydroxyethylcellulose, and homo- or co-polymeric polycarboxylic acid or their salts are other examples of binder agents in accord with the invention.

The particulate can also include other components that are conventional in detergent compositions, provided that these are not incompatible per se and do not interfere with the building function of the crystalline layered silicate. Thus the particulate can include up to 50% by weight of the particulate of an anionic, nonionic, ampholytic or zwitterionic surfactant or a mixture of any of these and certain preferred particulate embodiments incorporate surfactants. Examples of such surfactants are described more fully hereinafter. However it is important that any surfactant material that is incorporated into the particulate does not introduce a level of free (unbound) moisture that can even partially dissolve the crystalline layered silicate. For this purpose, the surfactant should be solid and should preferably contain no more than about 5% free (unbound) moisture, preferably no more than 2% free moisture and most preferably less than 1% free moisture.

Other ingredients can also be incorporated in a total amount of up to 50% by weight of the particulate, subject to the same conditions set out above for the inclusion of surfactants. Thus such optional ingredients should preferably be solid at normal (ambient) temperatures, and should contain no more than 5% by weight of free (unbound) moisture, preferably less than 1%.

Non-aqueous liquid components can be incorporated in amounts of up to 20% by weight of the particulate provided that the crystalline layered silicate does not have an appreciable solubility in such components. This also applies to normally solid components applied in a molten form to serve as agglomeration/coating agents for the particulate.

The particulates can take a variety of physical forms such as extrudates, marumes, agglomerates, flakes or compacted granules. A preferred process for preparing compacted granules comprising crystalline layered silicate and a solid, water-soluble ionisable material has been disclosed in PCT Patent Application No. WO 92/03286.

The detergent compositions of the present invention will include as the second essential component an alkali metal percarbonate bleach, normally in the form of the sodium salt. The alkali metal percarbonate bleach is incorporated at a level of from 3% to 40% by weight, more preferably from 5% to 30% by weight and most preferably from 10% to 25% by weight of the composition.

Sodium percarbonate, which is the preferred percarbonate, is an addition compound having a formula corresponding to $2Na_2CO_3.3H_2O_2$, and is available commercially as a crystalline solid. Although the percarbonate can be incorporated into detergent compositions without additional protection, preferred executions of such compositions utilise a coated form of the material. The most preferred coating material comprises salt of an alkali metal sulphate and carbonate. Such coatings together with coating processes have previously been described in GB-1,466,799, granted to Interox on Mar. 9th, 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is form 0.1 to 3, preferably n is from 0.3 to 1.0 and most preferably n is from 0.2 to 0.5.

Another suitable coating material is sodium silicate of $SiO_2$:$Na_2O$ ratio from 1.6:1 to 3.4:1, preferably 2.8:1, applied as an aqueous solution to give a level of from 2% to 10%, (normally from 3% to 5%) of silicate solids by weight of the percarbonate. Magnesium silicate can also be included in the coating. Other suitable coating materials include the alkali and alkaline earth metal sulphates and carbonates.

Whilst heavy metals present in the sodium carbonate used to manufacture the percarbonate can be controlled by inclusion of sequestrants in the reaction mixture, the percarbonate still requires protection from heavy metals present as impurities in other ingredients of the product. Accordingly, in detergent compositions utilising percarbonate as the perhydrate salt, the total level of Iron, Copper and Manganese ions in the product should not exceed 25 ppm and preferably should be less than 20 ppm in order to avoid an unacceptably adverse effect on percarbonate stability. Detergent compositons in which alkali metal percarbonate bleach has enhanced stability are disclosed in the Applicant's PCT Patent Application, WO 92/06163.

The compositions of the invention contain, as the third essential component from 0.05% to 10% by weight of the composition, preferably from 0.05% to 1% by weight, most preferably from 0.1% to 0.5% by weight of ethylenediamine-N,N'-disuccinic acid (EDDS) or the alkali metal, alkaline earth metal, ammonium, or substituted ammonium salts thereof, or mixtures thereof. Preferred EDDS compounds for granular detergent compositions are the free acid form and the sodium or magnesium salt or complex thereof. Examples of such preferred sodium salts of EDDS include NaEDDS, $Na_2$EDDS and $Na_3$EDDS. Examples of such preferred magnesium complexes of EDDS include $M_g$ EDDS and $M_{g2}$ EDDS.

The magnesium complexes are the most preferred for inclusion in granular compositions in accord with the invention. These complexes may be added to the compositions as such, or they may be formed during the process for making the composition by the reaction of an inert magnesium salt such as $MgCl_2$ or $MgSO_4$ with an EDDS compounds added as either the free acid, or as a salt or complex. Where the EDDS compound is added in the making process, together with the inert magnesium salt, it is preferred that the molar ratio of magnesium to EDDS should be greater than 1:1, preferably greater than 3:1, to ensure formation of the desired magnesium complexes.

The structure of the acid form of EDDS is as follows.

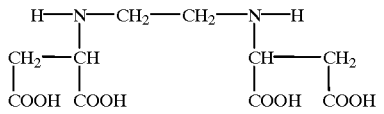

EDDS can be synthesised, for example, from readily available, inexpensive starting materials such as maleic anhydride and ethylenediamine as follows.

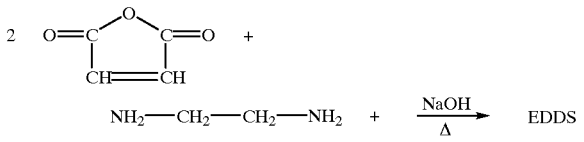

A more complete disclosure of methods for synthesising EDDS from commercially available starting materials can be found in U.S. Pat. No. 3,158,635, Kezerian and Ramsay, issued Nov. 24, 1964.

The synthesis of EDDS from maleic anhydride and ethylene diamine yields a mixture of three optical isomers, [R,R], [S,S], and [S,R], due to the two asymmetric carbon atoms. The biodegradation of EDDS is optical isomer-specific, with the [S,S] isomer degrading most rapidly and extensively, and for this reason the [S,S] isomer is most preferred for inclusion in the compositions of the invention.

The [S,S] isomer of EDDS can be synthesised from L-aspartic acid and 1,2-dibromoethane, as follows.

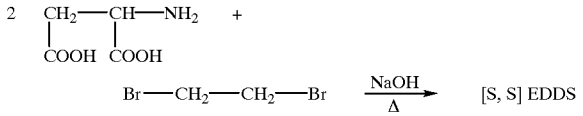

A more complete disclosure of the reaction of L-aspartic acid with 1,2-dibromoethane to form the [S,S] isomer of EDDS can be found in Neal and Rose, Stereospecific Ligands and Their Complexes of Ethylenediamine-discuccinic Acid, *Inorganic Chemistry*, Vol. 7 (1968), pp. 2405–2412.

Detergent compositions in accordance with the invention also comprise in general items those ingredients commonly found in detergent products which may include organic surfactants, detergent builders, oxygen bleach systems and ancillary materials such as anti-redeposition and soil suspension agents, suds suppressors, heavy metal ion chelating agents, enzymes, optical brighteners, photoactivated bleaches, perfumes and colours. Some products also include fabric softening and antistatic agents.

A wide range of surfactants can be used in the detergent compositions. A typical listing of anionic, nonionic, ampholytic and zwitterionic classes, and species of these surfactants, is given in U.S. Pat. No. 3,929,678 issued to Laughlin and Heuring on Dec., 30, 1975. A list of suitable cationic surfactants is given in U.S. Pat. No. 4,259,217 issued to Murphy on Mar. 31, 1981.

Mixtures of anionic surfactants are suitable herein, particularly blends of sulphate, sulphonate and/or carboxylate surfactants. Mixtures of sulphonate and sulphate surfactants are normally employed in a sulphonate to sulphate weight ratio of from 5:1 to 1:2, preferably from 3:1 to 2:3, more preferably from 3:1 to 1:1. Preferred sulphonates include alkyl benzene sulphonates having from 9 to 15, especially 11 to 13 carbon atoms in the alkyl radical, and alpha-sulphonated methyl fatty acid esters in which the fatty acid is derived from a $C_{12}$–$C_{18}$ fatty source, preferably from a $C_{16}$–$C_{18}$ fatty source. In each instance the cation is an alkali metal, preferably sodium. Preferred sulphate surfactants in such sulphonate sulphate mixtures are alkyl sulphates having from 12 to 22, preferably 16 to 18 carbon atoms in the alkyl radical.

Another useful surfactant system comprises a mixture of two alkyl sulphate materials whose respective mean chain lengths differ from each other. One such system comprises a mixture of $C_{14}$–$C_{15}$ alkyl sulphate and $C_{16}$–$C_{18}$ alkyl sulphate in a weight ratio of $C_{14}$–$C_{15}$: $C_{16}$–$C_{18}$ of from 3:1 to 1:1. The alkyl sulphates may also be combined with alkyl ethoxy sulphates having from 10 to 20, preferably 10 to 16 carbon atoms in the alkyl radical and an average degree of ethoxylation of 1 to 6. The cation in each instance is again an alkali metal, preferably sodium.

Another highly preferred anionic surfactant system comprises a mixture of a $C_{12}$–$C_{20}$ alkyl sulfate with a water soluble $C_{11\text{-}18}$ alkyl ethoxysulfate salt containing an average of from 1 to 7 ethoxy groups per mole wherein the weight ratio of alkyl sulfate to alkyl ethoxysulfate salt lies in the range form 2:1 to 19:1, more preferably from 3:1 to 12:1 and most preferably from 3.5:1 to 10:1.

The $C_{14}$–$C_{20}$ alkyl sulfate salts may be derived from natural or synthetic hydrocarbon sources. Preferred examples of such salts include the substantially branched $C_{14\text{-}15}$ alkyl sulfate salts, that is where the degree of branching of the $C_{14}$–$C_{15}$ alkyl chain is greater than about 20%. Such substantially branched $C_{14}$–$C_{15}$ alkyl sulfate salts are usually derived from synthetic sources. Also preferred are $C_{16}$–$C_{20}$ alkyl sulfate salts which are usually derived from natural sources such as tallow fat and marine oils.

The $C_{11}$–$C_{18}$ alkyl ethoxysulfate salt comprises a primary alkyl ethoxysulfate which is derived from the condensation product of a $C_{11}$–$C_{18}$ alcohol condensed with an average of from one to seven ethylene oxide groups, per mole. Preferred are the $C_{12}$–$C_{15}$ alkyl ethoxysulfate salts with an average of from one to five ethoxy groups per mole, and most preferably with an average of from one to three ethoxy groups per mole.

Thus $C_{11\text{-}18}$ alcohol itself can be obtained from natural or synthetic sources. Thus, $C_{11}$–$C_{18}$ alcohols, derived from natural fats, or Ziegler olefin build-up, or OXO synthesis can form suitable sources for the alkyl group. Examples of synthetically derived materials include Dobanol 25 (RTM) sold by Shell chemicals (UK) Ltd which is a blend of $C_{12}$–$C_{15}$ alcohols, Ethy 24 sold by the Ethyl Corporation, a blend of $C_{13\text{-}15}$ alcohols in the ratio 67% $C_{13,\ 33}$% $C_{15}$ sold under the trade name Lutensol by BASF GmbH and Synperonic (RTM) by ICI Ltd., and Lial 125 sold by Liquichimica Italiana. Examples of naturally occurring materials from which the alcohols can be derived are coconut oil and palm kernel oil and the corresponding fatty acids. The level of $C_{11}$–$C_{18}$ alkyl ethoxysulfate is preferably from 0.5% to 10% more preferably from 0.5% to 5% and most preferably from 1% to 3% by weight of the composition.

Other anionic surfactants suitable for the purposes of the invention are the alkali metal sarcosinates of formula $$R—CON(R^1)CH_2COOM$$

wherein R is a $C_9$–$C_{17}$ linear or branched alkyl or alkenyl group, $R^1$ is a $C_1$–$C_4$ alkyl group and M is an alkali metal ion. Preferred examples are the lauroyl, Cocoyl ($C_{12}$–$C_{14}$), myristyl and oleyl methyl sarcosinates in the form of their sodium salts.

One class of nonionic surfactants useful in the present invention comprises condensates of ethylene oxide with a hydrophobic moiety, providing surfactants having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing an average of from 3–8 moles of ethylene oxide per mole of alcohol, particularly the $C_{14}$–$C_{15}$ primary alcohols containing an average of from 6–8 moles of ethylene oxide per mole of alcohol and the $C_{12}$–$C_{15}$ primary alcohols containing an average of from 3–5 moles of ethylene oxide per mole of alcohol.

Another class of nonionic surfactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.1 to 4, the compounds including less than 10% unreacted fatty alcohol and less than 50% short chain alkyl polyglucosides. Compounds of this type and their use in detergent compositions are disclosed in EP-B 0070074, 0070077, 0075996 and 0094118.

Another preferred nonionic surfactant is a polyhydroxy fatty acid amide surfactant compound having the structural formula:

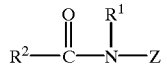

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof: and Z is a polyhydroxyhydrocarbyl having a linear hydrocarbyl chain with at least 3 hydroxyls directly connected to the chain, or an alkoxlylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2$–CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc. Preferred compound are N-methyl N-1deoxyglucityl $C_{14}$–$C_{18}$ fatty acid amides.

A further class of surfactants are the semi-polar surfactants such as amine oxides. Suitable amine oxides are selected from mono $C_8$–$C_{20}$, preferably $C_{10-C14}$ N-alkyl or alkenyl amine oxides and propylene-1,3-diamine dioxides wherein the remaining N positions are substituted by methyl, hydroxyethyl or hydroxpropyl groups.

Cationic surfactants can also be used in the detergent compositions herein and suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl groups.

The detergent compositions preferably comprise from 3% to 30% of surfactant but more usually comprise from 7% to 20%, more preferably from 10% to 15% surfactant by weight of the compositions.

Combinations of surfactant types are preferred, more especially anionic-nonionic and also anionic-nonionic-cationic blends. Particularly preferred combinations are described in GB-A-2040987 and EP-A-0087914. Although the surfactants can be incorporated into the compositions as mixtures, it is preferable to control the point of addition of each surfactant in order to optimise the physical characteristics of the composition and avoid processing problems.

Preferred modes and orders of surfactant addition are described hereinafter.

Another highly preferred component of the detergent compositions of the invention is a detergent builder system comprising one or more other non-phosphate detergent builders, hereinafter referred to as additional non-phosphate detergent builders. These can include, but are not restricted to, alkali metal aluminosilicates, monomeric polycarboxylates, homo or copolymeric polycarboxylic acids or their salts in which the polycarboxylic acid comprises at least two carboxylic radicals separated from each other by not more than two carbon atoms, carbonates, silicates and mixtures of any of the foregoing.

Whilst a range of aluminosilicate ion exchange materials can be used, preferred sodium aluminosilicate zeolites have the unit cell formula $$Na_z[(AlO_2)_z(SiO_2)_y]xH_2O$$

wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The above aluminosilicate ion exchange materials are further chatacterised by a particle size diameter of from 0.02 to 10 micrometers, preferably from 0.2 to 4 micro meters. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains Ca++/gallon/minute/gram/gallon)] of aluminosilicate (anhydrous basis), and which generally lies within the range of from 130 mg equivalent of $CaCO_3$/liter/minute/(gram/liter) [2 grains/gallon/minute/(gram/gallon)] to 390 mg equivalent of $CaCO_3$/liter/minute/(gram/liter) [6 grains/gallon/minute/(gram/gallon)], based on calcium ion hardness.

Optimum aluminosilicates for builder purposes exhibit a calcium ion exchange rate of at least 260 mg equivalent of $CaCO_3$/liter/minute/(gram/liter) [4 grains/gallon/minute/(gram/gallon)].

Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite P, Zeolite X, Zeolite HS, Zeolite MAP, Zeolite MAB, and mixtures thereof. In an especially preferred embodiment, the crystalline aluminosilicate ion exchange material is Zeolite A and has the formula $$Na_{12}[(AlO_2)_{12}(SiO_2)_{12}].xH_2O$$

wherein x is from 20 to 30, especially 27. Zeolite X of formula $Na_{86}[(AlO_2)_{86}(SiO_2)_{106}]$. $276H_2O$ is also suitable, as well as Zeolite HS of formula $Na_6[(AlO_2)_6(SiO_2)_6]$ $7.5H_2O$).

Suitable water-soluble monomeric or oligomeric carboxylate builders can be selected from a wide range of compounds but such compounds preferably have a first carboxyl logarithmic acidity/constant ($pK_1$) of less than 9, preferably of between 2 and 8.5, more preferably of between 4 and 7.5.

The logarithmic acidity constant is defined by reference to the equilibrium $$H^+ + A^- \rightleftharpoons HA$$

where A is the fully ionized carboxylate anion of the builder salt.

The equilibrium constant for dilute solutions is therefore given by the expression $$K_1 = \frac{[HA]}{[H^+]\ [A^-]}$$

and $pK_1 = \log_{10}K$.

For the purposes of this specification, acidity constants are defined at 25° C. and at zero ionic strength. Literature values are taken where possible (see Stability Constants of Metal-Ion Complexes, Special Publication No. 25, The Chemical Society, London): where doubt arises they are determined by potentiometric titration using a glass electrode.

The carboxylate or polycarboxylate builder can be momomeric or oligomeric in type although monomeric polycarboxylates are generally preferred for reasons of cost and performance.

Monomeric and oligomeric builders can be selected from acyclic, alicyclic, heterocyclic and aromatic carboxylates having the general formulae (a)

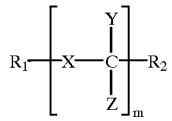

(b)

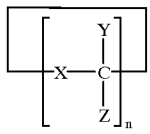

or (c)

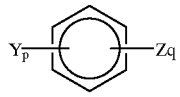

wherein $R_1$ represents H, $C_{1-30}$ alkyl or alkenyl optionally substituted by hydroxy, carboxy, sulfo or phosphono groups or attached to a polyethylenoxy moiety containing up to 20 ethyleneoxy groups; $R_2$ represents H, $C_{1-4}$ alkyl, alkenyl or hydroxy alkyl, or alkaryl, sulfo, or phosphono groups;

X represents a single bond; O; S; SO; $SO_2$; or $NR_1$;

Y represents H; carboxy;hydroxy; carboxymethyloxy; or $C_{1-30}$ alkyl or alkenyl optionally substituted by hydroxy or carboxy groups;

Z represents H; or carboxy;

m is an integer from 1 to 10;

n is an integer from 3 to 6;

p, q are integers from 0 to 6, p+q being from 1 to 6; and wherein,

X, Y, and Z each have the same or different representations when repeated in a given molecular formula, and wherein at least one Y or Z in a molecule contain a carboxyl group.

Suitable carboxylates containing one carboxy group include the water soluble salts of lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343.

Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or copolymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 70,000, especially about 40,000. These materials are normally used at levels of from 0.5% to 10% by weight more preferably from 0.75% to 8%, most preferably from 1% to 6% by weight of the composition.

The compositions of the invention may contain optional chelant ingredients. Such optional chelants may include the organic phosphonates, including amino alkylene poly (alkylene phosphonate), alkali metal ethane 1-hydroxy diphosphonates, nitrilo tremethylene phosphonates, ethylene diamine tetra methylene phosphonates and diethylene triamine penta methylene phosphonates. The phosphonate compounds may be present either in their acid form or as a complex of either an alkali or alkaline metal ion, the molar ratio of said metal ion to said phosphonate compound being at least 1:1. Such complexes are described in U.S. Pat. No. 4,259,200. Preferably, the organic phosphonate compounds where present are in the form of their magnesium salt. The level of phosphorus containing chelants in the compositions of the invention is preferably minimised, with their complete exclusion from the compositions being most preferred.

Whilst soluble silicates serve a variety of purposes in conventional formulations, their presence is unnecessary in compositions in accordance with the present invention. However as the crystalline layered silicate, which forms part of the builder system of the detergent composition, must be added as a dry mix ingredient, soluble silicates may still be useful as structurants in the spray dried granules that normally form part of a detergent composition. This is particularly desirable if the spray dried granule does not incorporate an aluminosilicate builder and would otherwise comprise only organic materials. Suitable silicates are those having an $SiO_2$:$Na_2O$ ratio in the range from 1.6 to 3.4, ratios from 2.0 to 2.8 being preferred.

For the purposes of detergent compositions incorporating the crystalline layered silicates as part of the builder system, the additional non-phosphate builders will comprise from 0% to 70% by weight of the compositions, more preferably from 10% to 40% by weight. Within the preferred detergent compositions, sodium aluminosilicate such as Zeolite A will comprise from 20% to 80% by weight of the total amount of builder, a monomeric or oligomeric carboxylate will comprise from 5% to 30% by weight of the total amount of builder and the crystalline layered silicate will comprise from 10% to 65% by weight of the total amount of builder. In such compositions the builder system preferably also incorporates a combination of auxiliary inorganic and organic builders such as sodium carbonate and maleic anhydride/acrylic acid copolymers in amounts of up to 35% by weight of the total builder.

The detergent compositions of the present invention may include, in addition to the alkali metal percarbonate bleach, an additional inorganic perhydrate bleach. This additional inorganic perhydrate bleach may be any of the inorganic perhydrate salts such as perborate, persulfate, perphosphate and persilicate salts. Preferably however, the compositions of the invention contain no inorganic perborate salts.

Bleach systems incorporated into detergent compositions of the present invention preferably include solid peroxyacid bleach precursors (bleach activators). The solid peroxyacid bleach precursors are normally incorporated at a level of from 1% to 20%, more preferably from 1% to 15%, most preferably from 1% to 10% by weight of the composition.

These precursors probably contain one or more N- or O-acyl groups, which precursors can be selected from a wide range of classes. Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864,798, 1147871 and 2143231 and imides such as are disclosed in GB-A-855735 & 1246338.

Particularly preferred precursor compounds are the N,N, $N^1N^1$ tetra acetylated compounds of formula

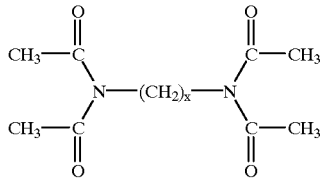

wherein x can be O or an integer between 1 & 6.

Examples include tetra acetyl methylene diamine (TAMD) in which x=1, tetra acetyl ethylene diamine (TAED) in which x=2 and tetraacetyl hexylene diamine (TAHD) in which x=6. These and analogous compounds are described in GB-A-907356. The most preferred peroxyacid bleach precursor is TAED.

Another preferred class of peroxyacid bleach activator compounds are the amide substituted compounds of the following general formulae:

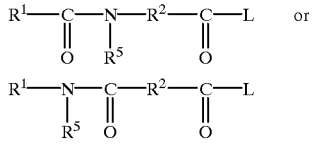

wherein $R^1$ is an aryl or alkaryl group with from about 1 to about 14 carbon atoms, $R^2$ is an alkylene, arylene, and alkarylene group containing from about 1 to 14 carbon atoms, and $R^5$ is H or an alkyl, aryl, or alkaryl group containing 1 to 10 carbon atoms and L can be essentially any leaving group. $R^1$ preferably contains from about 6 to 12 carbon atoms. $R^2$ preferably contains from about 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms total. Amide substituted bleach activator compounds of this type are described in EP-A-01 70386.

Other peroxyacid bleach precursor compounds include sodium nonanoyloxy benzene sulfonate, sodium trimethyl hexanoyloxy benzene sulfonate, sodium acetoxy benzene sulfonate and sodium benzoyloxy benzene sulfonate as disclosed in, for example, EP-A-0341947.

The compositions of the invention may also contain organic peroxyacids at a level of from 1% to 15% by weight, more preferably from 1% to 10% by weight of the composition. A particularly preferred class are the amide substituted peroxyacids of general formulae:

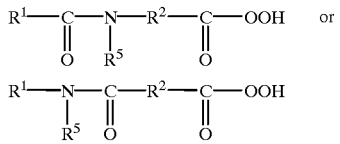

where $R^1$, $R^2$ and $R^5$ are as defined previously for the corresponding amide substituted peroxyacid bleach activator compounds.

Other organic peroxyacids include diperoxy dodecanedioc acid, diperoxy tetra decanedioc acid, diperoxyhexadecanedioc acid, mono-and diperazelaic acid, mono- and diperbrassylic acid, monoperoxy phthalic acid, perbenzoic acid, and their salts as disclosed in, for example, EP-A-0341 947.

Detergent compositions in which solid peroxybleach precursors are protected via an acid coating to minimise fabric colour damage are disclosed in the Applicant's copending British Application No. 9102507.2 filed Feb. 6, 1991.

Anti-redeposition and soil-suspension agents suitable herein include cellulose derivatives such as methylcellulose, carboxymethylcellulose and hydroxyethycellulose, homo-or co-polymeric polycarboxylic acids or their salts and ployamino compounds. Polymers of this type include the polyacrylates and copolymers of maleic anhydride with ethylene, methylvinyl ether or methacrylic acid, the maleic anhydride constituting at least 20 mole percent of the copolymer disclosed in detail in EP-A-137669. Polyamino compounds such as those derived from aspartic acid are disclosed in EP-A-305282, EP-A-305283 and EP-A-351629. These materials are normally used at levels of from 0.5% to 10% by weight, more preferably from 0.75% to 8%, most preferably from 1% to 6% by weight of the composition.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

Preferred optical brighteners are anionic in character, examples of which are disodium $4,4^1$-bis-(2-diethanolamino-4-anilino-s-triazin-6-ylamino)stilbene-$2:2^1$ disulphonate, disodium $4,4^1$-bis-(2-morpholino-4-anilino-2-triazin-6-ylaminostilbene-$2:2^1$-disulphonate,disodium $4,4^1$-bis-(2,4-dianilino-s-triazin-6-ylamino)stilbene-$2:2^1$-disulphonate, monosodium $4^1,4^{11}$-bis-( 2,4-dianilino-s-triazin-6-ylamino)stilbene-2-sulphonate, disodium $4,4^1$-bis-(2-anilino-4-(N-methyl-N-2-hydroxyethylamino)-2-triazin-6-ylamino)stilbene-$2,2^1$-disulphonate, disodium $4,4^1$-bis-(4-phenyl-2,1,3-triazol-2-yl)stilbene-$2,2^1$ disulphonate, disodium $4,4^1$ bis(2-anilino-4-(1-methyl-2-hydroxyethylamino)-s-triazin-6-ylamino)stilbene-$2,2^1$ disulphonate and sodium 2(stilbyl-$4^{11}$-(naphtho-$1^1,2^1$:4,5)-1,2,3-triazole-$2^{11}$-sulphonate.

Soil-release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4116885 and 4711730 and European Published Patent Application No. 0272033. A particular preferred polymer in accordance with EP-A-0272033 has the formula $(CH_3(PEG)_{43})_{0.75}(POH)_{0.25}[T—PO)_{2.8}(T—PEG)_{0.4}]T(PO—H)_{0.25}((PEG)_{43}CH_3)_{0.75}$ where PEG is —$(OC_2H_4)O$—, PO is $(OC_3H_6O)$ and T is $(pCOC_6H_4CO)$.

Certain polymeric materials such as polyvinyl pyrrolidones, typically of MWt 5000–20000, preferably 10000–15000, also form useful agents in preventing the transfer of labile dyestuffs between fabrics during the washing process.

Another optional detergent composition ingredient is a suds suppressor, exemplified by silicones, and silica-silicone mixtures. Silicones can be generally represented by alkylated polysiloxane materials while silica is normally used in finely divided forms, exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent-impermeable carrier. The impermeable carrier may be, for example, starch. The particulates preferably also comprise one or more binder agents such as stearyl alcohol or the $C_{15}$–$C_{20}$ alcohol ethoxylates containing from 20–100 moles of ethylene oxide per mole of alcohol. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC0544, commercially available from Dow Corning, which is a siloxane/glycol copolymer.

Highly preferred storage-stable granular suds controlling agents have been described in the co-pending European Applications 91201343.0 and 91870007.1.

The suds suppressors described above are normally employed at levels of from 0.001% to 5% by weight of the composition, preferably from 0.1% to 3% by weight.

The preferred methods of incorporation comprise either application of the suds suppressors in liquid form by spray-on to one or more of the major components of the composition or alternatively the formation of the suds suppressors into separate particulates that can then be mixed with the other solid components of the composition. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Another optional ingredient useful in the present invention is one or more enzymes.

Preferred enzymatic materials include the commercially available amylases, neutral and alkaline proteases, lipases, esterases and cellulases conventionally incorporated into detergent compositions. Suitable enzymes are discussed in U.S. Pat. Nos. 3,519,570 and 3,533,139.

Preferred commercially available protease enzymes include those sold under the tradenames Alcalase and Savinase by Novo Industries A/S (Denmark) and Maxatase by International Bio-Synthetics, Inc. (The Netherlands).

Preferred amylases include, for example, -amylases obtained from a special strain of B licheniforms, described in more detail in GB-1,269,839 (Novo). Preferred commercially available amylases include for example, Rapidase, sold by International Bio-Synthetics Inc, and Termamyl, sold by Novo Industries A/S.

An especially preferred lipase enzyme is manufactured and sold by Novo Industries A/S (Denmark) under the trade name Lipolase (Biotechnology Newswatch, Mar. 7, 1988, page 6) and mentioned along with other suitable lipases in EP-A-0258068 (Novo).

Fabric softening agents can also be incorporated into detergent compositions in accordance with the present invention. These agents may be inorganic or organic in type. Inorganic softening agents are examplified by the smectite clays disclosed in GB-A-1,400,898. Organic fabric softening agents include the water insoluble tertiary amines as disclosed in GB-A-1514276 and EP-B-0011340.

Their combination with mono $C_{12}$–$C_{14}$ quaternary ammonium salts is disclosed in EP-B-0026527 & 528. Other useful organic fabric softening agents are the dilong chain amides as disclosed in EP-B-0242919. Additional organic ingredients of fabric softening systems include high molecular weight polyethylene oxide materials as disclosed in EP-A-0299575 and 0313146.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight. Where a portion of the composition is spray dried, these materials can be added to the aqueous slurry fed to the spray drying tower, although in some instances it may be more convenient to add them as a dry mixed particulate, or spray them as a molten liquid on to other solid components of the composition.

In general detergent compositions in accordance with the present invention can be made via a variety of methods including dry mixing, spray drying, agglomeration and granulation and preferred methods involve combinations of these techniques. A preferred method of making the compositions involves a combination of spray drying, agglomeration in a high speed mixer and dry mixing.

The bulk density of the granular detergent compositions of the present invention may be in the range of about 450 to 650 g/liter as is typical for conventional laundry detergent compositions. Alternatively, the granular detergent compositions may be concentrated granular detergent compositions that are characterised by a relatively high density in comparison with conventional laundry detergent compositions. Such high density compositions have a bulk density of at least 650 g/liter, more usually at least 700 g/liter and more preferably in excess of 800 g/liter.

Bulk density is measured by means of a simple funnel and cup device consisting of a conical funnel moulded rigidly on a base and provided with a flap valve at its lower extremity to allow the contents of the funnel to be emptied into an axially aligned cylindricl cup disposed below the funnel. The funnel is 130 mm and 40 mm at its respective upper and lower extremities. It is mounted so that the lower extremity is 140 mm above the upper surface of the base. The cup has an overall height of 90 mm, an internal height of 87 mm and an internal diameter of 84 mm. Its nominal volume is 500 ml.

To carry out a measurement, the funnel is filled with powder by hand pouring, the flap valve is opened and powder allowed to overfill the cup. The filled cup is removed from the frame and excess powder removed from the cup by passing a straight edged implement e.g. a knife, across its upper edge. The filled cup is then weighed and the value obtained for the weight of powder doubled to provide the bulk density in g/liter. Replicate measurements are made as required.

Concentrated detergent compositions also normally incorporate at least one multi-ingredient component i.e. they do not comprise compositions formed merely by dry-mixing individual ingredients. Compositions in which each individual ingredient is dry-mixed are generally dusty, slow to dissolve and also tend to cake and develop poor particle flow characteristics in storage.

Detergent compositions in accordance with the invention may comprise at lease two particulate multi-ingredient components. The first component comprises at least 15%, conventionally from 25% to 50%, but more preferably no more than 35% by weight of the composition and the second component from 1% to 50%, more preferably 10% to 40% by weight of the composition.

The first component comprises a particulate incorporating an anionic surfactant in an amount of from 0.75% to 40% by weight of the powder and one or more inorganic and/or organic salts in an amount of from 99.25% to 60% by weight of the powder. The particulate can have any suitable form such as granules, flakes, prills, marumes or noodles but is preferably granular. The granules themselves may be agglomerates formed by pan or drum agglomeration or by in-line mixers but are customarily spray dried particles produced by atomising an aqueous slurry of the ingredients in a hot air stream which removes most of the water. The spray dried granules may then be subjected to densification steps, e.g. by high speed cutter mixers and/or compacting mills, to increase density before being reagglomerated. For illustrative purposes, the first component is described hereinafter as a spray dried powder.

Suitable anionic surfactants for the purposes of the first component have been found to be slowly dissolving linear alkyl sulfate salts in which the alkyl group has an average of from 16 to 22 carbon atoms, and linear alkyl carboxylate salts in which the alkyl group has an average of from 16 to 24 carbon atoms. The alkyl groups for both types of surfactant are preferably derived from natural sources such as tallow fat and marine oils.

The level of anionic surfactant in the spray dried powder forming the first component is from 0.75% to 40% by weight, more usually 2.5% to 25% preferably from 3% to 20% and most preferably from 5% to 15% by weight. Water-soluble surfactants such as linear alkyl benzene sulphonates or $C_{14}$–$C_{15}$ alkyl sulphates can be included or alternatively may be applied subsequently to the spray dried powder by spray on.

The other major ingredient of the spray dried powder is one or more inorganic or organic salts that provide the crystalline structure for the granules. The inorganic and/or organic salts may be water-soluble or water-insoluble, the latter type being comprised by the, or the major part of the, water-insoluble builders where these form part of the builder ingredient. Suitable water soluble inorganic salts include the alkali metal carbonates and bicarbonates. Amorphous alkali metal silicates may also be used to provide structure to the spray dried granule provided that aluminosilicate does not form part of the spray dried component, although preferably the amount of amorphous alkali metal silicate used is kept to a minimum.

However, in concentrated detergent compositions it is preferred that no sodium sulphate is added as a separate ingredient and its incorporation as a by-product e.g. with sulph(on)ated surfactants, should be minimised.

Where an aluminosilicate zeolite forms the, or part of the, builder ingredient, it is preferred that it is not added directly by dry-mixing to the other components, but is incorporated into the multi-ingredient component(s).

The first component can also include up to 15% by weight of miscellaneous ingredients such as brighteners, anti-redeposition agents, photoactivated bleaches (such as tetrasulfonated zinc phthalocyanine) and chelants. Where the first component is a spray dried powder it will normally be dried to a moisture content of from 7% to 11% by weight, more preferably from 8% to 10% by weight of the spray dried powder. Moisture contents of powders produced by other processes such as agglomeration may be lower and can be in the range 1–10% by weight.

The particle size of the first component is conventional and preferably not more than 5% by weight should be above 1.4 mm, while not more than 10% by weight should be less than 0.15 mm in maximum dimension. Preferably at least 60%, and most preferably at least 80%, by weight of the powder lies between 0.7 mm and 0.25 mm in size. For spray dried powders, the bulk density of the particles from the spray drying tower is conventionally in the range from 540 to 600 g/liter and this is then enhanced by further processing steps such as size reduction in a high speed cutter/mixer followed by compaction. Alternatively, processes other than spray drying may be used to form a high density particulate directly.

A second component of a preferred composition in accordance with the invention is another multi-ingredient particulate containing a water soluble surfactant.

This may be anionic, nonionic, cationic or semipolar in type or a mixture of any of these. Suitable surfactants are listed hereinbefore but preferred surfactants are $C_{14}$–$C_{15}$ alkyl sulphates, linear $C_{11}$–$C_{15}$ alkyl benzene sulphonates and fatty $C_{14}$–$C_{18}$ methyl ester sulphonates.

The second component may have any suitable physical form, i.e. it may take the form of flakes, prills, marumes, noodles, ribbons, or granules which may be spray-dried or non spray-dried agglomerates. Although the second component could in theory comprise the water soluble surfactant on its own, in practice at least one organic or inorganic salt is included to facilitate processing. This provides a degree of crystallinity, and hence acceptable flow characteristics, to the particulate and may be any one or more of the organic or inorganic salts present in the first component.

The particle size range of the second component should be such as to obviate segregation from the particles of the first component when blended therewith. Thus not more than 5% by weight should be above 1.4 mm while not more than 10% should be less than 0.15 mm in maximum dimension.

The bulk density of the second component will be a function of its mode of preparation. However, the preferred form of the second component is a mechanically mixed agglomerate which may be made by adding the ingredients dry or with an agglomerating agent to a pan agglomerator, Z blade mixer or more preferably an in-line mixer such as those manufactured by Schugi (Holland) BV, 29 Chroomstraat 8211 AS, Lelystad, Netherlands and Gebruder Lodige MaschinenbanGmbH, D-4790 Paderborn 1, Elsenerstrasse 7–9, Postfach 2050 F.R.G. By this means the second component can be given a bulk density in the range from 650 g/liter to 1190 g/liter more preferably from 750 g/liter to 850 g/liter.

Preferred compositions include a level of alkali metal carbonate in the second component corresponding to an amount of from 3% to 15% by weight of the composition, more preferably from 5% to 12% by weight. This will provide a level of carbonate in the second component of from 20% to 40% by weight.

A highly preferred ingredient of the second component is also a water insoluble aluminosilicate ion exchange material of the synthetic zeolite type, described hereinbefore, present at from 10% to 35% by weight of the second component. The amount of water insoluble aluminosilicate material incorporated in this way is from 1% to 10% by weight of the composition, more preferably from 2% to 8% by weight.

In one process for preparing the second component, the surfactant salt is formed in situ in an inline mixer. The liquid acid form of the surfactant is added to a mixture of particulate anhydrous sodium carbonate and hydrated sodium aluminosilicate in a continuous high speed blender, such as a Lodige C6 mixer, and neutralised to form the surfactant salt whilst maintaining the particulate nature of the mixture. The resultant agglomerated mixture forms the second component which is then added to other components of the product.

In a variant of this process, the surfactant salt is preneutralised and added as a viscous paste to the mixture of the other ingredients. In the variant, the mixer serves merely to agglomerate the ingredients to form the second component.

In one process for making the granular detergent compositions of the invention, part of the spray dried product comprising the first granular component is diverted and subjected to a low level of nonionic surfactant spray on before being reblended with the remainder. The second granular component is made using the process described above. The first and second components together with the crystalline layered silicate particulate compositions, the perhydrate bleach and any peroxy acid bleach precursor particles, other dry mix ingredients such as any carboxylate chelating agent, soil-release polymer and enzyme are then fed to a conveyor belt, from which they are transferred to a horizontally rotating drum in which perfume and silicone suds suppressor are sprayed on to the product. A further drum mixing step may be employed in which a low (approx. 2% by weight) level of finely divided crystalline material is introduced to increase density and improve granular flow characteristics.

In preferred concentrated detergent products incorporating an alkali metal percarbonate as the perhydrate salt it has been found necessary to control several aspects of the product such as its heavy metal ion content and its equilibrium relative humidity. Sodium percarbonate-containing compositions of this type having enhanced stability are disclosed in the commonly assigned PCT Application No. WO 92/06163.

Compositions in accordance with the invention can also benefit from delivery systems that provide transient localised high concentrations of product in the drum of an automatic washing machine at the start of the wash cycle, thereby also avoiding problems associated with loss of product in the pipework or sump of the machine.

Delivery to the drum can most easily be achieved by incorporation of the composition in a bag or container from which it is rapidly releasable at the start of the wash cycle in response to agitation, a rise in temperature or immersion in the wash water in the drum. Alternatively the washing machine itself may be adapted to permit direct addition of the composition to the drum e.g. by a dispensing arrangement in the access door.

Products comprising a detergent composition enclosed in a bag or container are usually designed in such a way that container integrity is maintained in the dry state to prevent egress of the contents when dry, but are adapted for release of the container contents on exposure to a washing environment, normally on immersion in an aqueous solution.

Usually the container will be flexible, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene. In a variant of the bag or container form, laminated sheet products can be employed in which a central flexible layer is impregnated and/or coated with a composition and then one or more outer layers are applied to produce a fabric-like aesthetic effect. The layers may be sealed together so as to remain attached during use, or may separate on contact with water to facilitate the release of the coated or impregnated material.

An alternative laminate form comprises one layer embossed or deformed to provide a series of pouch-like containers into each of which the detergent components are deposited in measured amounts, with a second layer overlying the first layer and sealed thereto in those areas between the pouch-like containers where the two layers are in contact. The components may be deposited in particulate, paste or molten form and the laminate layers should prevent egress of the contents of the pouch-like containers prior to their addition to water. The layers may separate or may remain attached together on contact with water, the only requirement being that the structure should permit rapid release of the contents of the pouch-like containers into solution. The number of pouch-like containers per unit area of substrate is a matter of choice but will normally vary between 500 and 25,000 per square meter.

Suitable materials which can be used for the flexible laminate layers in this aspect of the invention include, among others, sponges, paper and woven and non-woven fabrics.

However the preferred means of carrying out the process of the invention is to introduce the composition into the liquid surrounding the fabrics that are in the drum via a reusable dispensing device having walls that are permeable to liquid but impermeable to the solid composition.

Devices of this kind are disclosed in European Patent Application Publication Nos. 0343069 & 0343070. The latter Application discloses a device comprising a flexible sheath in the form of a bag extending from a support ring defining an orifice, the orifice being adapted to admit to the bag sufficent product for one washing cycle. A portion of the washing medium flows through the orifice into the bag, dissolves the product, and the solution then passes outwardly through the orifice into the washing medium. The support ring is provided with a masking arrangement to prevent egress of wetted, undissolved, product, this arrangement typically comprising radially extending walls extending from a central boss in a spoked wheel configuration, or a similar structure in which the walls have a helical form.

An article by J. Bland published in Manufacturing Chemist, November 1989, pages 41–46 also describes especially preferred dispensing devices for use with granular products which are of a type commonly known as the "granulette".

The invention is illustrated in the following non limiting Examples, in which all percentages are on a weight basis unless otherwise stated.

In the detergent compositions, the abbreviated component identifications have the following meanings:

| | |
|---|---|
| LAS | Sodium linear $C_{12}$ alkyl benzene sulphonate |
| TAS | Sodium tallow alkyl sulphate |
| XYAS | Sodium $C_{1X}$–$C_{1Y}$ alkyl sulfate |
| XYEZ | A $C_{1X-1Y}$ primary alcohol condensed with an average of Z moles of ethylene oxide |
| 45EY | A $C_{14}$–$C_{15}$ predominantly linear primary alcohol condensed with an average of Y moles of ethylene oxide |
| 25E3S | $C_{12}$–$C_{15}$ sodium alkyl sulfate condensed with an average of three moles of ethylene oxide per mole. |
| TAED | Tetraacetyl ethylene diamine |
| Silicate | Amorphous Sodium Silicate ($SiO_2$:$Na_2O$ ratio normally follows) |
| NaSKS-6 | Crystalline layered silicate of formula $\delta$-$Na_2Si_2O_5$ |
| Carbonate | Anhydrous sodium carbonate |
| Zeolite A | Hydrated Sodium Aluminosilicate of formula $Na_{12}(AlO_2SiO_2)_{12}.27H_2O$ having a primary particle size in the range from 1 to 10 micrometers |
| Citrate | Tri-sodium citrate dihydrate |
| Citric | Citric Acid |
| Photoactivated Bleach | Tetra sulphonated Zinc phthalocyanine |
| MA/AA | Copolymer of 1:4 maleic/acrylic acid, average molecular weight about 80,000. |
| Perborate | Anhydrous sodium perborate monohydrate bleach, empirical formula $NaBO_2.H_2O_2$ |
| Percarbonate | Anhydrous sodium percarbonate bleach of empirical formula $2Na_2CO_3.3H_2O_2$ coated with a mixed salt of formula $Na_2SO_4.n.Na_2CO_3$ where n is 0.29 and where the weight ratio of percarbonate mixed salt is 39:1 |
| Enzyme | Mixed proteolytic and amylolytic enzyme sold by Novo Industries AS. |
| Brightener | Disodium 4,4'-bis(2-morpholino-4-anilino-s-triazin-6-ylamino) stilbene-2:2'-disulphonate. |
| DETPMP | Diethylene triamine penta (methylene phosphonic acid), marketed by Monsanto under the Trade name Dequest 2060 |
| Suds Suppressor | 25% paraffin wax Mpt 50° C., 17% hydrophobic silica, 58% paraffin oil. |
| EDDS | Ethylenediamine-N,N'-disuccinic acid, [S,S] isomer in the form of the sodium salt. |
| Sulphate | Anhydrous sodium sulphate. |
| FAA | $C_{16}$–$C_{18}$ polyhydroxy fatty acid amide. |

EXAMPLE 1

The following granular detergent products were prepared (parts by weight). Composition A is a prior art composition, and compositions 1 to 7 are in accordance with the invention.

| | A | 1 | 2 | 3 | 4 | 5 | 6 | 7 |
|---|---|---|---|---|---|---|---|---|
| LAS | 7.0 | — | — | — | — | — | — | — |
| TAS | 2.0 | 5.0 | 4.0 | 3.0 | — | — | — | — |
| 45AS | — | — | 4.0 | 5.0 | 6.0 | 5.0 | 8.0 | — |
| 25AS | — | — | 4.0 | — | — | 3.0 | — | 8.0 |
| 24AS | — | 8.0 | — | — | — | — | — | — |
| 25E3S | — | — | — | 2.5 | 2.0 | 1.5 | 1.0 | — |
| 45E9 | — | — | 3.0 | — | — | — | — | — |
| 45E7 | 4.0 | — | — | — | 3.0 | 3.0 | 3.0 | 1.0 |
| 25E5 | — | — | 3.0 | 9.0 | — | — | — | — |
| 25E3 | — | — | — | — | 6.0 | 3.0 | 1.5 | 5.0 |
| 24E3 | — | 3.0 | — | — | — | — | — | — |
| FAA | — | 3.0 | — | — | — | 2.5 | 1.5 | 2.0 |
| Zeolite A | 20.0 | 20.0 | 15.0 | 17.0 | 13.0 | 15.0 | 25.0 | 17.0 |
| Citrate | 5.0 | — | — | 2.0 | — | — | — | 3.0 |
| Citric | — | 2.0 | 5.0 | 1.0 | 3.0 | 3.0 | 1.0 | 3.0 |
| Na SKS-6 | — | 15.0 | 10.0 | 7.0 | 12.0 | 10.0 | 5.0 | 9.0 |
| Carbonate | 15.0 | 9.0 | 10.0 | 11.0 | 9.0 | 14.0 | 7.0 | 14.0 |
| Silicate | 3.0 | 1.0 | — | 1.0 | — | 1.0 | — | 2.0 |
| MA/AA | 4.0 | 3.0 | 2.0 | 3.0 | 5.0 | 4.0 | 1.0 | 2.0 |
| Enzyme | 1.8 | 0.7 | 1.5 | 2.3 | 2.0 | 3.0 | 2.5 | 2.7 |
| Perborate | 16.0 | — | — | — | — | — | — | — |
| Percarbonate | — | 15.0 | 25.0 | 20.0 | 25.0 | 20.0 | 30.0 | 15.0 |
| TAED | 5.0 | 3.0 | 5.0 | 7.0 | 6.0 | 6.5 | 4.0 | 6.0 |
| DETPMP | 0.4 | — | — | — | — | — | — | — |
| EDDS | 0 | 0.1 | 0.2 | 0.2 | 0.3 | 0.4 | 0.5 | 0.4 |
| Suds Suppressor | 2.0 | 2.0 | 2.0 | 2.0 | 2.0 | 2.0 | 2.0 | |
| Sulphate, moisture and minors to balance | | | | | | | | |

What is claimed is:

1. A laundry detergent composition comprising:

(a) from 7% to 20% by weight of a crystalline layered silicate builder material of formula $LMSi_xO_{2x+1}.yH_2O$ wherein L is an alkali metal, and M is sodium or hydrogen, x is a number from 1.9 to 4 and y is a number from 0 to 20;

(b) from 3% to 40% by weight of an alkali metal percarbonate bleach;

(c) from 0.05% to 10% by weight of a compound selected from the group consisting of ethylenediamine-N,N'-disuccinic acid, alkali metal, alkaline earth metal, ammonium, substituted ammonium salts thereof, or mixtures thereof; and (d) from 3% to 30% by weight of an anionic surfactant comprising a mixture of a $C_{13}$–$C_{20}$ alkyl sulfate salt with a water soluble $C_{11}$–$C_{19}$ alkyl ethoxysulfate salt containing an average of from 1 to 7 ethoxy groups per mole wherein the weight ratio of said alkyl sulfate salt to said alkyl ethoxysulfate salt lies in the range from 2:1 to 19:1.

2. A detergent composition according to claim 1 wherein the alkyl sulfate salt is a $C_{14}$–$C_{15}$ alkyl sulfate salt, the alkyl ethoxysulfate salt is a $C_{12}$–$C_{15}$ alkyl ethoxysulfate salt containing an average of three ethoxy groups per mole and wherein said weight ratio lies in the range from 3.5:1 to 10:1.

3. A detergent composition according to claim 1 wherein the crystalline layered silicate material is $\delta$-$Na_2Si_2O_5$ (Na SKS6), and wherein the composition further comprises from 0% to 70% by weight of additional non-phosphate detergent builder compounds and from 3% to 30% by weight of a nonionic surfactant which is a polyhydroxy fatty acid amide of the formula

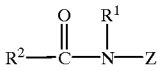

wherein $R^1$ is selected from the group consisting of H, $C_1$–$C_4$ hydrocarbyl, 2-hydroxyethyl, 2-hydroxypropyl and mixtures thereof, $R^2$ is $C_5$–$C_{31}$ hydrocarbyl and Z is a poly hydroxyhydrocarbyl having a linear hydrocarbon chain with at least 3 hydroxy groups directly connected to said chain, or an alkoxylated derivative thereof.

* * * * *